US007653948B2

(12) United States Patent
Schwenner

(10) Patent No.: US 7,653,948 B2
(45) Date of Patent: Feb. 2, 2010

(54) MASSAGING CLOTHING

(75) Inventor: Brigitte Schwenner, 25 Hubbard Dr., White Plains, NY (US) 10605

(73) Assignee: Brigitte Schwenner, White Plains, NY (US)

( * ) Notice: Subject to any disclaimer, the term of this patent is extended or adjusted under 35 U.S.C. 154(b) by 304 days.

(21) Appl. No.: 11/273,110

(22) Filed: Nov. 14, 2005

(65) Prior Publication Data

US 2007/0118951 A1 May 31, 2007

(51) Int. Cl.
*A41D 13/00* (2006.01)

(52) U.S. Cl. ..... 2/69

(58) Field of Classification Search ..... 2/114, 2/115, 244, 161.8, 239, 912, 908, 920, 15; 450/112, 144

See application file for complete search history.

(56) References Cited

U.S. PATENT DOCUMENTS 1,666,686 A * 4/1928 Chisholm ..... 139/420 R
1,811,843 A * 6/1931 Chisholm ..... 139/421
2,269,088 A * 1/1942 Fleer et al. ..... 66/172 R
2,708,271 A * 5/1955 Steinberg ..... 450/97
2,962,384 A * 11/1960 Ljungbo ..... 428/197
3,028,857 A * 4/1962 Parker ..... 601/136
3,478,748 A * 11/1969 Bjorn-Larsen ..... 450/111
3,540,974 A * 11/1970 Broadhurst ..... 428/87
3,711,868 A * 1/1973 Kristof ..... 2/237
3,723,231 A * 3/1973 Clay et al. ..... 428/86
4,149,274 A * 4/1979 Garrou et al. ..... 2/239
4,180,606 A * 12/1979 Hance et al. ..... 428/88
4,206,514 A * 6/1980 Yamauchi ..... 2/239
4,359,783 A * 11/1982 Andrews ..... 2/161.8
4,438,533 A * 3/1984 Hefele ..... 2/97
4,509,510 A * 4/1985 Hook ..... 601/28
4,687,527 A * 8/1987 Higashiguchi ..... 156/72
4,728,538 A * 3/1988 Kaspar et al. ..... 427/288
4,744,351 A * 5/1988 Grundei et al. ..... 602/19
4,926,568 A * 5/1990 Coffman ..... 36/15
5,029,343 A * 7/1991 McIntyre ..... 2/115
5,084,914 A * 2/1992 Hesch ..... 2/79
5,086,519 A 2/1992 Rokasky
5,210,877 A * 5/1993 Newman ..... 2/456
5,322,056 A 6/1994 Menghi et al.
5,381,558 A 1/1995 Lo
5,535,453 A * 7/1996 Howard ..... 2/269
5,539,932 A * 7/1996 Howard ..... 2/269

(Continued)

OTHER PUBLICATIONS

Http://www.phschool.com/science/science_news/articles/caught_on_tape.html*Science News Online*—"Caught on Tape: Gecko-inspired adhesive is superstrong" by Sorcha McConagh, Two (2) pages, visited on Aug. 3, 2005.

(Continued)

*Primary Examiner*—Alissa L Hoey
(74) *Attorney, Agent, or Firm*—Pillsbury Winthrop Shaw Pittman LLP

(57) ABSTRACT

A massaging garment worn in close proximity to a wearer's skin is made from a stretchable fabric having a plurality of fibers. Pushing elements for pushing the wearer's skin away from the stretchable fabric and pulling elements for pulling the wearer's skin toward the stretchable fabric are secured thereto. The pushing and pulling elements produce a massaging effect on the wearer's skin.

16 Claims, 5 Drawing Sheets

U.S. PATENT DOCUMENTS 5,551,173 A * 9/1996 Chambers ..... 36/44
5,553,398 A * 9/1996 Schnewlin-Maier ..... 36/43
5,652,961 A * 8/1997 Knight-Yurt ..... 2/114
5,675,992 A 10/1997 Wrightenberry
5,759,163 A 6/1998 Hwang
5,765,226 A 6/1998 Douady et al.
5,774,892 A * 7/1998 Tisdale et al. ..... 2/69
5,778,702 A * 7/1998 Wrightenberry ..... 66/178 R
5,794,266 A * 8/1998 Han ..... 2/159
5,802,611 A * 9/1998 McKenzie et al. ..... 2/69
5,806,093 A * 9/1998 Summers ..... 2/69
5,913,406 A * 6/1999 Lofgren et al. ..... 2/51
5,924,133 A * 7/1999 Zapiti ..... 2/77
5,940,888 A * 8/1999 Sher ..... 2/267
5,951,931 A * 9/1999 Murasaki et al. ..... 264/167
5,978,965 A 11/1999 Summers
5,997,380 A 12/1999 Yang
6,088,831 A * 7/2000 Jensen et al. ..... 2/2.5
6,127,018 A * 10/2000 Akeno et al. ..... 428/100
6,138,281 A * 10/2000 Chiaruttini ..... 2/239
6,193,679 B1 2/2001 Quinn
6,234,987 B1 5/2001 Chen
6,247,215 B1 * 6/2001 Van Alboom et al. ..... 28/160
6,255,235 B1 * 7/2001 Hiraoka et al. ..... 442/101
6,260,200 B1 7/2001 Alfred
6,308,337 B1 * 10/2001 Penley ..... 2/239
6,314,584 B1 * 11/2001 Errera ..... 2/239
6,350,504 B1 * 2/2002 Alboom et al. ..... 428/88
6,360,372 B2 * 3/2002 Oster ..... 2/126
6,499,142 B1 * 12/2002 Lee ..... 2/106
6,562,271 B2 * 5/2003 Hiraoka et al. ..... 264/257
6,737,160 B1 * 5/2004 Full et al. ..... 428/397
6,763,525 B1 7/2004 Spector
6,868,556 B1 * 3/2005 Jenkins ..... 2/77
6,872,439 B2 * 3/2005 Fearing et al. ..... 428/99
6,880,268 B2 * 4/2005 Chen ..... 36/43
6,921,316 B1 * 7/2005 Jian ..... 450/38
6,927,182 B2 * 8/2005 Rock et al. ..... 442/312
7,011,723 B2 * 3/2006 Full et al. ..... 156/60
7,012,525 B1 * 3/2006 Ghioto ..... 340/552
7,335,271 B2 * 2/2008 Autumn ..... 156/60
7,428,772 B2 * 9/2008 Rock ..... 28/159
2003/0115663 A1 * 6/2003 Turner et al. ..... 2/459
2003/0124312 A1 * 7/2003 Autumn ..... 428/141
2003/0167027 A1 9/2003 Estrella et al.
2004/0005454 A1 * 1/2004 Full et al. ..... 428/343
2005/0050607 A1 * 3/2005 Myers ..... 2/69
2005/0058674 A1 * 3/2005 Joseph et al. ..... 424/401
2005/0148984 A1 * 7/2005 Lindsay et al. ..... 604/387
2006/0000005 A1 * 1/2006 Foreman et al. ..... 2/115
2006/0237126 A1 * 10/2006 Guffrey et al. ..... 156/265
2006/0272071 A1 * 12/2006 Mickle ..... 2/69
2007/0000010 A1 * 1/2007 Benini ..... 2/69

OTHER PUBLICATIONS

International Search Report issued on Jun. 19, 2008 in International Application No. PCT/US2006/44010.

* cited by examiner

MASSAGING CLOTHING

BACKGROUND OF THE INVENTION

1. Field of the Invention

The invention relates a massaging garment worn in close proximity to a wearer's skin. More particularly, the invention relates to a massaging garment having a plurality of pushing elements and a plurality of pulling elements for producing a massaging effect on the wearer's skin.

2. The Prior Art

Devices relating to various garments incorporating massaging means are disclosed in U.S. Pat. No. 5,381,558 Lo; U.S. Pat. No. 5,978,965 to Summers; U.S. Pat. No. 5,759,163 to Hwang; U.S. Pat. No. 3,028,857 to Parker; U.S. Pat. No. 5,997,380 to Yang; U.S. Pat. No. 6,763,525 to Spector; U.S. Pat. No. 6,234,987 to Chen; U.S. Pat No. 6,193,679 to Quinn; U.S. Pat. No. 5,086,519 to Rokasky; U.S. Pat. No. 5,765,226 to Douady et al.; U.S. Pat. No. 5,322,056 to Menghi et al.; and in United States Patent Application Publication No. US2003/0167027 to Estrella et al., the disclosures of which are incorporated herein by reference.

SUMMARY OF THE INVENTION

The invention relates a massaging garment worn in close proximity to a wearer's skin. More particularly, the invention relates to a massaging garment having a plurality of pushing elements and a plurality of pulling elements for producing a massaging effect on the wearer's skin.

A massaging garment according to an embodiment of the invention is worn in close proximity to a wearer's skin and comprises a stretchable fabric. A plurality of pushing elements are secured to the stretchable fabric for pushing the wearer's skin away from the stretchable fabric. A plurality of pulling elements are secured to the stretchable fabric for pulling the wearer's skin toward the stretchable fabric. The plurality of pushing elements and pulling elements produce a massaging effect on the wearer's skin as the wearer's body is moved.

One benefit of a massaging garment according to an embodiment of the invention is that the movement of a wearer's own body initiates the massage. Another benefit of a massaging garment according to an embodiment of the invention is that the pushing and pulling elements which produce the massaging effect may be incorporated into a woven or knit fabric and may be incorporated into a single or double layer fabric. A massaging garment according to an embodiment of the invention may be fully washable.

A further benefit of a massaging garment according to an embodiment of the invention is that the garment may be used with an antibacterial additive or a topical moisturizing or medical treatment. A massaging garment according to an embodiment of the invention may comprise various fashionable designs which are suitable not only for home or leisure use, but also for wear-outside the home, thereby increasing the opportunities for use of the massaging garment and the effectiveness of the massage.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
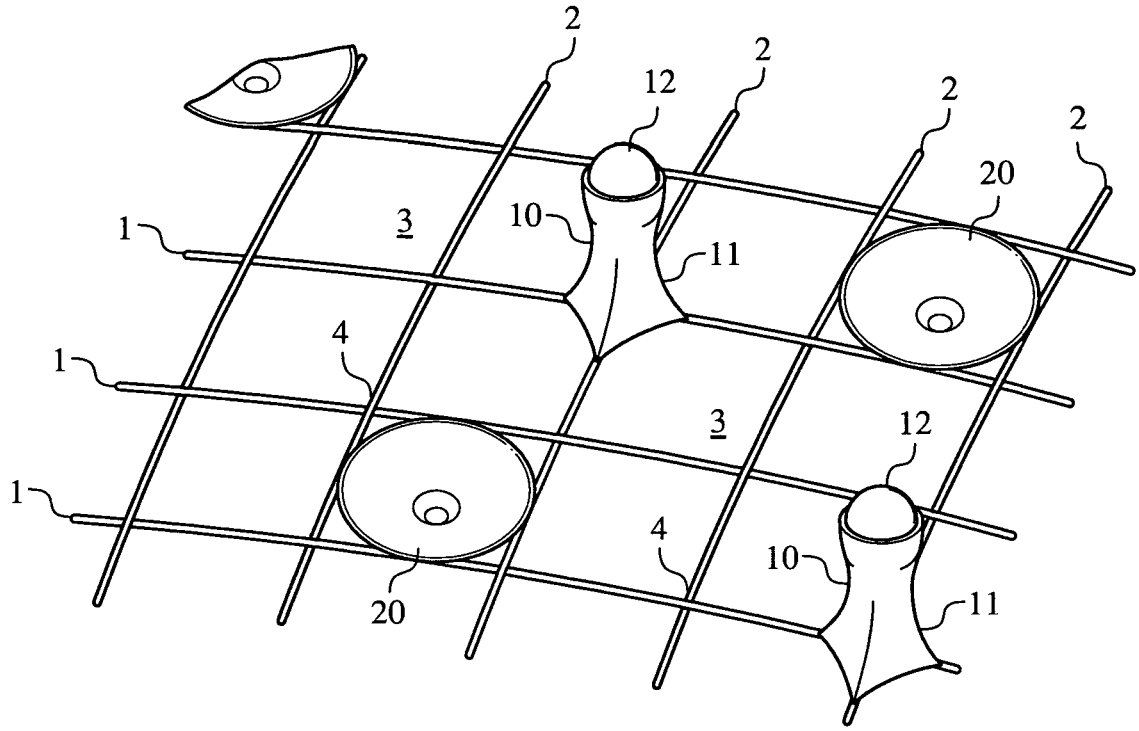
FIG. 1 shows a massaging garment comprising a single layer woven fabric according to an embodiment of the invention.

Referring now in detail to the drawings and, in particular, FIG. 1 shows a massaging garment comprising a single layer woven fabric according to an embodiment of the invention. The single layer woven fabric comprises a plurality of fibers 1, 2 which are arranged to form a plurality of spaces 3 between adjacent fibers and a plurality of intersections 4 where the individual fibers cross each other. Individual fibers 1 and 2 may run perpendicular to each other in the woven fabric.

The fabric may comprise a stretchable fabric, preferably a double stretch fabric, for example, spandex (elastane) or a blend including spandex and cotton. A double stretch fabric may enhance the massaging effect of a massaging garment according to an embodiment of the invention by permitting the massage effect to work in multiple directions. In a double stretch fabric, the massage may be effective on the length grain, cross grain and bias. Movement of the wearer's body initiates the massaging effect. The greater the movement of the wearer's body, the greater the massaging effect.

Figure 2:
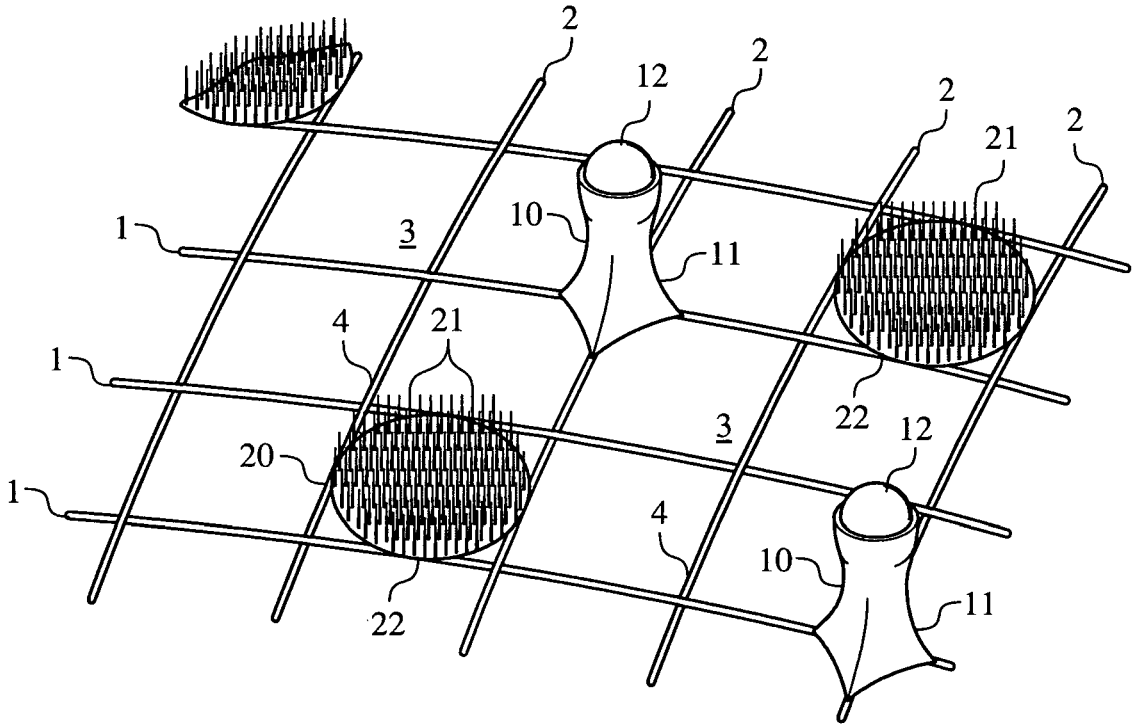
FIG. 2 shows a massaging garment comprising a single layer woven fabric according to another embodiment of the invention.

The massaging garment may include a plurality of pushing elements 10, which are secured to the stretchable fabric. The pushing elements 10 push a wearer's skin away from the stretchable fabric. As shown in FIGS. 1 and 2, pushing elements 10 may be disposed at the intersections 4 formed between fibers 1 and 2. The pushing elements 10 may also be disposed at the spaces 3 formed between adjacent fibers, as shown in the double layer construction illustrated in FIGS. 3 and 4.

Each of the plurality of pushing elements may comprise, for example a raised carrier 11 with a rounded top 12. The pushing elements may comprise a ball fitted to an upwardly projecting portion in the manner of a single ball bearing or may comprise a single piece projection having a rounded top portion. Preferably, the pushing elements 10 are secured to the stretchable fabric at an angle of approximately 90 degrees with respect to the plane of the fabric. Movement of the fabric causes a movement of the pushing elements 10 which contributes to the massaging effect.

The pushing elements 10 may comprise a thermoplastic fluoropolymer, such as for example, polytetrafluoroethylene (PTFE) or perfluoroalkoxy polymer resin (PFA). The dimensions of the pushing elements 10 may be in the range of approximately 1-2 mm in height and 0.1 to 1.0 mm in width.

The massaging garment may include a plurality of pulling elements 20, which are secured to the stretchable fabric. The pulling elements 20 pull a wearer's skin toward the stretchable fabric. Pulling elements 20 stick to the skin of the wearer of the massaging garment, pulling the skin toward the fabric.

Figure 3:
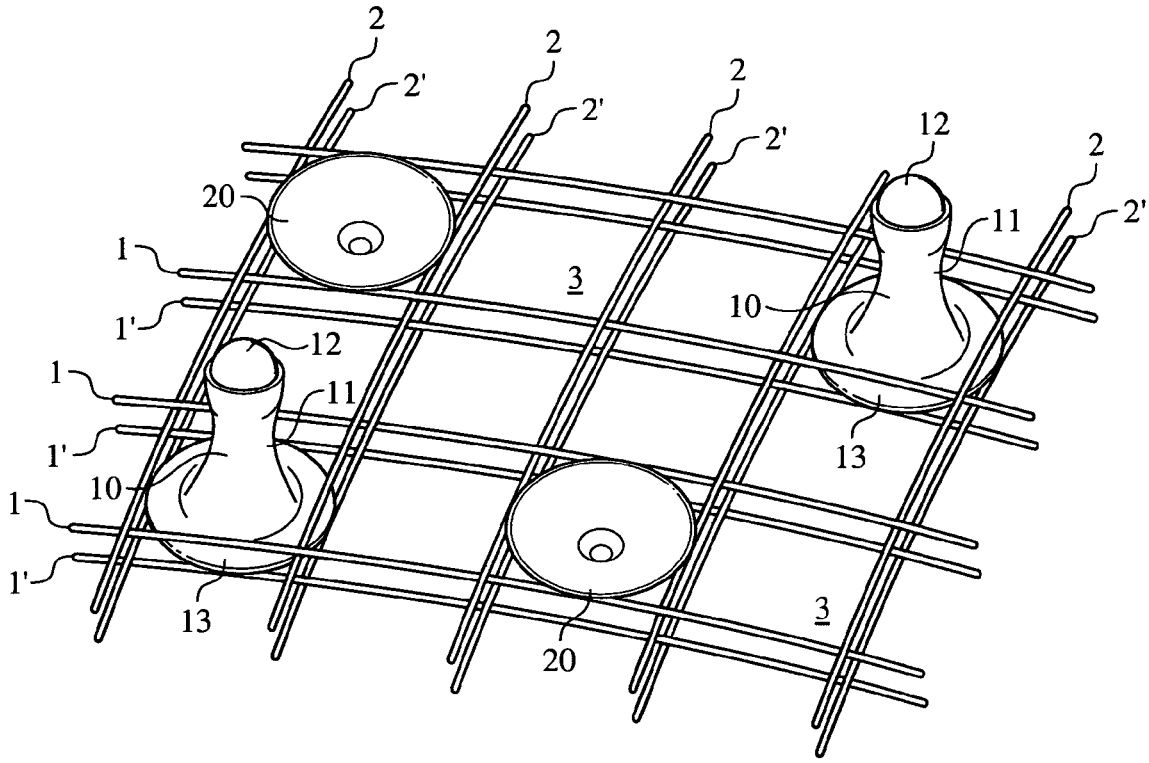
FIG. 3 shows a massaging garment comprising a double layer woven fabric according to an embodiment of the invention.
Figure 4:
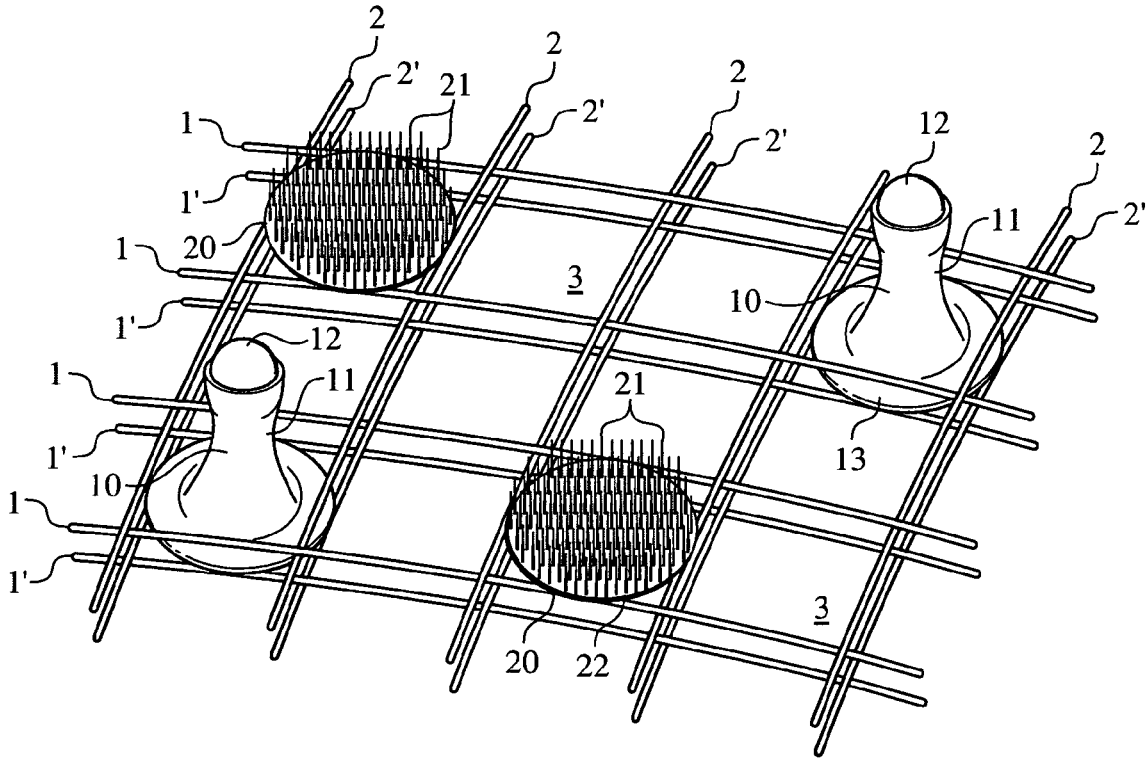
FIG. 4 shows a massaging garment comprising a double layer woven fabric according to another embodiment of the invention.

Pulling elements 20 may comprise suction cup type elements as shown in FIGS. 1 and 3, or a may comprise a plurality of hair-like projections 21 mounted to a flexible base 22, as shown in FIGS. 2 and 4. The suction cup type pulling elements 20 shown in FIGS. 1 and 3 are similar to those of a toy dart gun or the suckers on the tentacles of an octopus and function according to the same principles. The pulling elements illustrated in FIGS. 2 and 4 are similar in function to the setae of a gecko or other animal and function in a similar manner using capillary action to achieve adhesion.

The pulling devices 20 may be constructed from polytetrafluoroethylene (PTFE), perfluoroalkoxy polymer resin (PFA), polymide, silicone, polyester or other suitable materials. The hair-like projections 21 may be formed from hydrophobic or hydrophillic materials. The materials used to construct the pushing elements 10 and pulling elements 20 are such that the massaging garment may be cleaned in a conventional manner after use. For example, the massaging garment may be laundered and/or dry cleaned without any adverse effects on the fabric or the pushing or pulling elements.

As shown in FIGS. 3 and 4, the stretchable fabric may comprise a multiple layer fabric, for example a double layer fabric. A first layer is comprised a plurality of fibers 1', 2' and a second layer is formed from a plurality of fibers 1, 2. The first layer is secured to the second layer and a plurality of spaces 3 is formed between adjacent fibers in each layer.

A plurality of pushing elements 10 may be secured to the first layer of the stretchable fabric and disposed in the spaces 3 formed between adjacent fibers 1', 2' of the first layer. A plurality of pulling elements 20 is secured to the second layer of the stretchable fabric and disposed in the spaces 3 formed between adjacent fibers 1, 2 of the second layer. Pulling elements 20 in the double layer construction are as described in the foregoing. Pushing elements 10 in the double layer construction are as previously described and may further comprise a base portion 13 as shown. Base portion 13 may be in the form of a flattened portion which may be secured to the individual fibers defining the space 3 wherein the pushing element is disposed.

Figure 5:
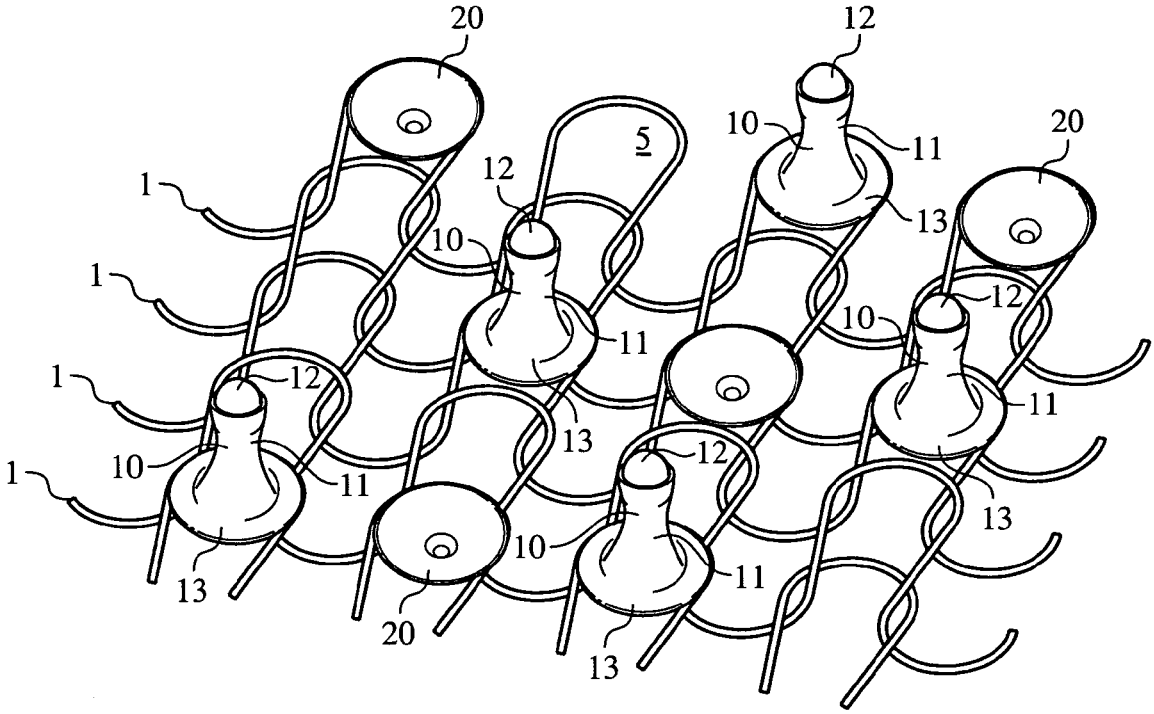
FIG. 5 shows a massaging garment comprising a knit fabric according to an embodiment of the invention.
Figure 6:
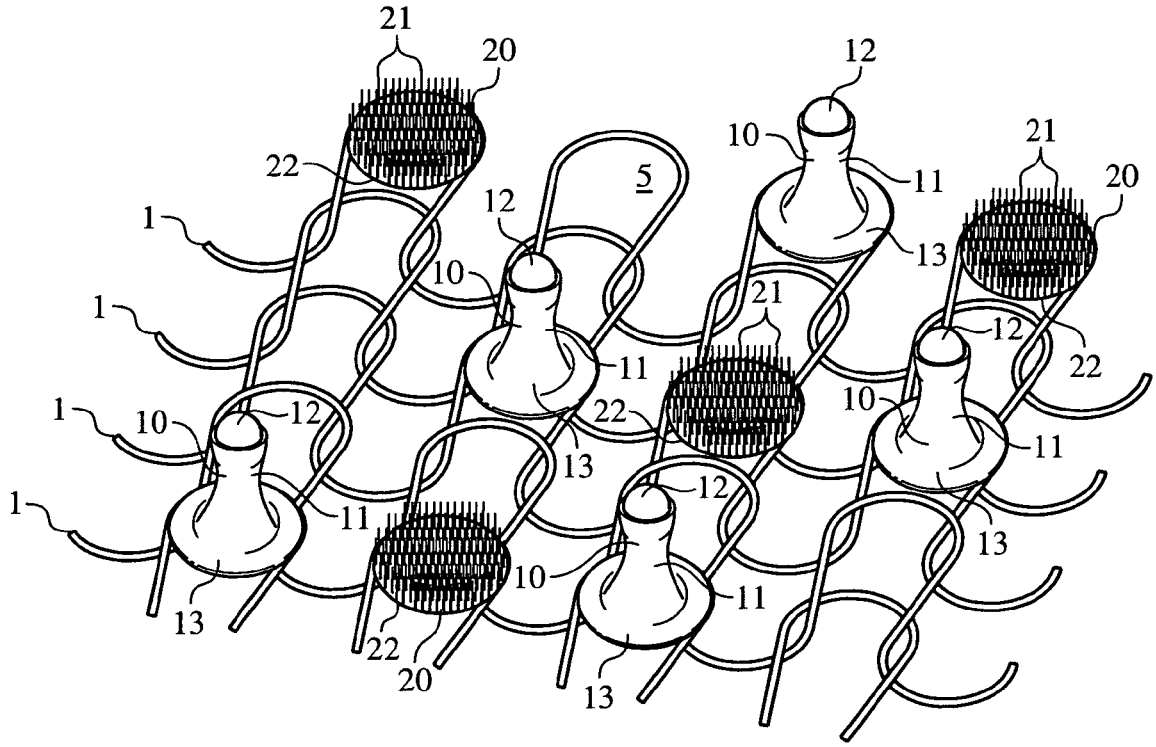
FIG. 6 shows a massaging garment comprising a knit fabric according to another embodiment of the invention.

As shown in FIGS. 5 and 6, the stretchable fabric may further comprise a knit fabric. The knit fabric may comprises a plurality of intertwined fibers 1 which are arranged to form a plurality of loops 5. Pushing elements 20 and pulling elements 20 are secured to the stretchable knit fabric and disposed at individual loops 5.

In use, the combination of pushing elements 10 and pulling elements 20 in a massaging garment according to an embodiment of the invention produce a pushing and pulling effect on the skin of the garment wearer which results in the massaging effect on the skin. This massaging effect may result in younger and healthier looking skin and may be useful in wrinkle, obesity and cellulite treatments. Additionally, a massaging garment according to an embodiment of the invention may be used in combination with various topical moisturizing or medical treatments. For example, the massaging effect may promote the absorption of topically applied moisturizers or medicines. An antibacterial additive may be added to the massaging garment to inhibit the production of bacteria and/or odor.

Figure 7:
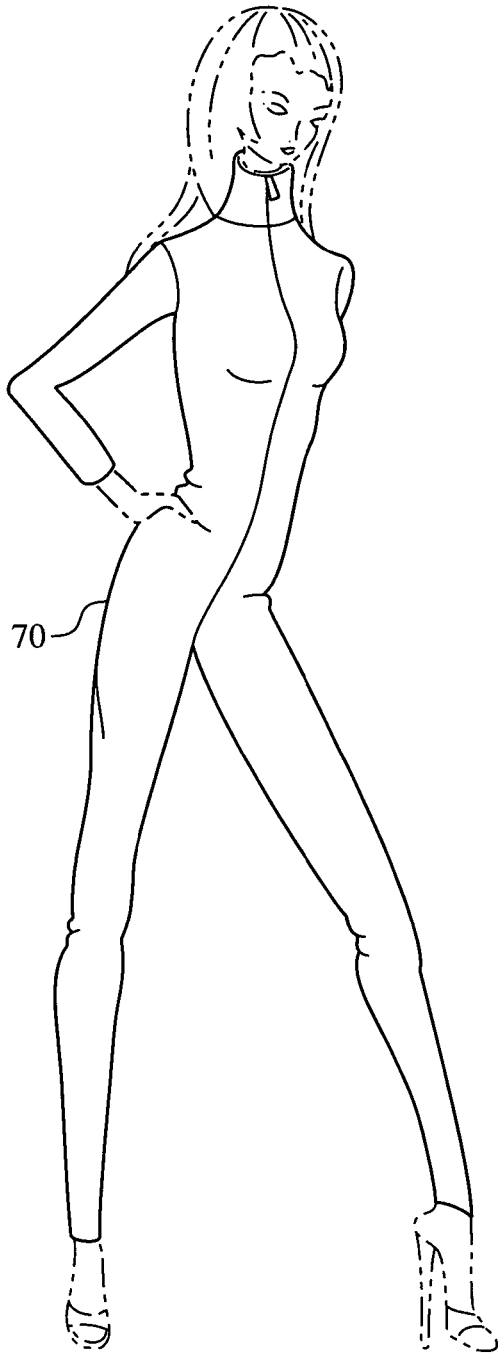
FIG. 7 shows a massaging garment comprising a body suit according to an embodiment of the invention.
Figure 8:
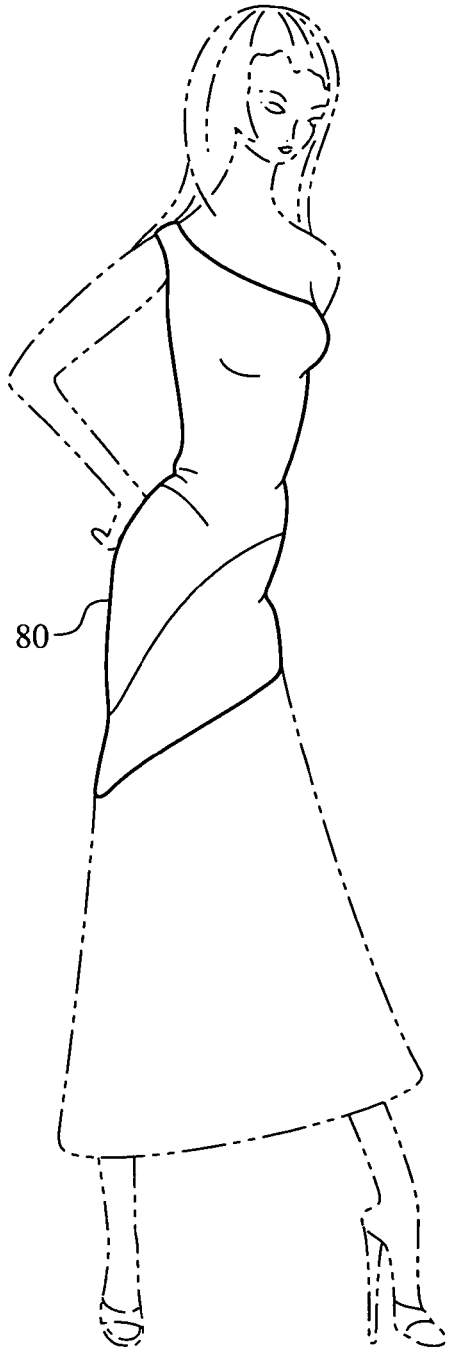
FIG. 8 shows a massaging garment comprising a skirt according to an embodiment of the invention.
Figure 9:
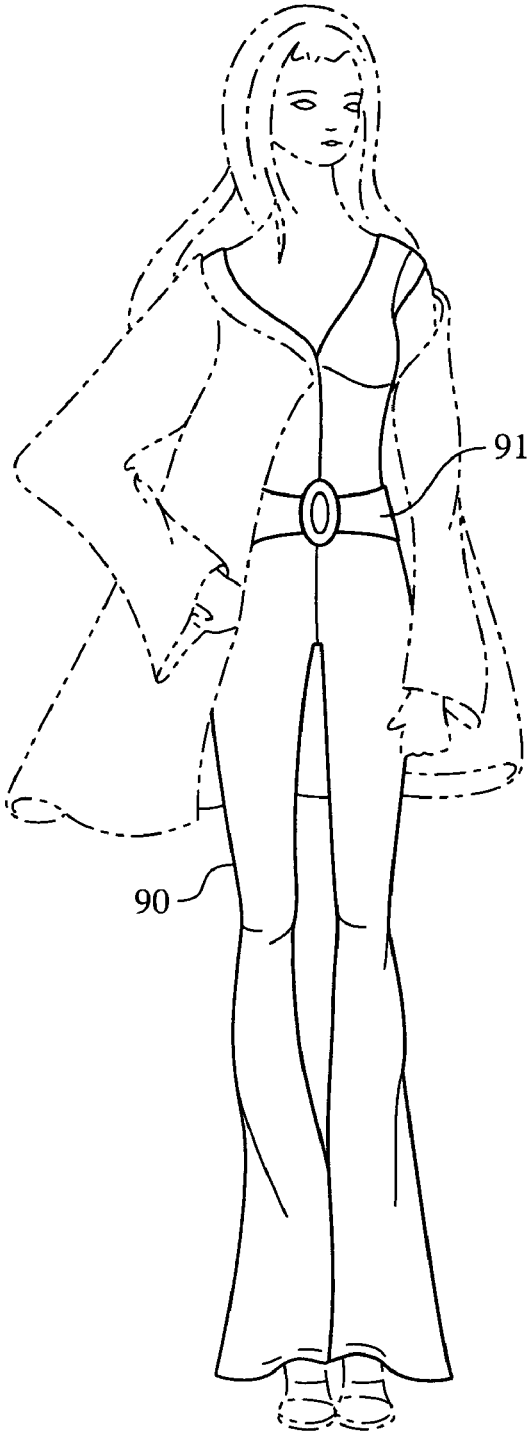
FIG. 9 shows massaging garments comprising a belt and a jump suit according to an embodiment of the invention.
Figure 10:
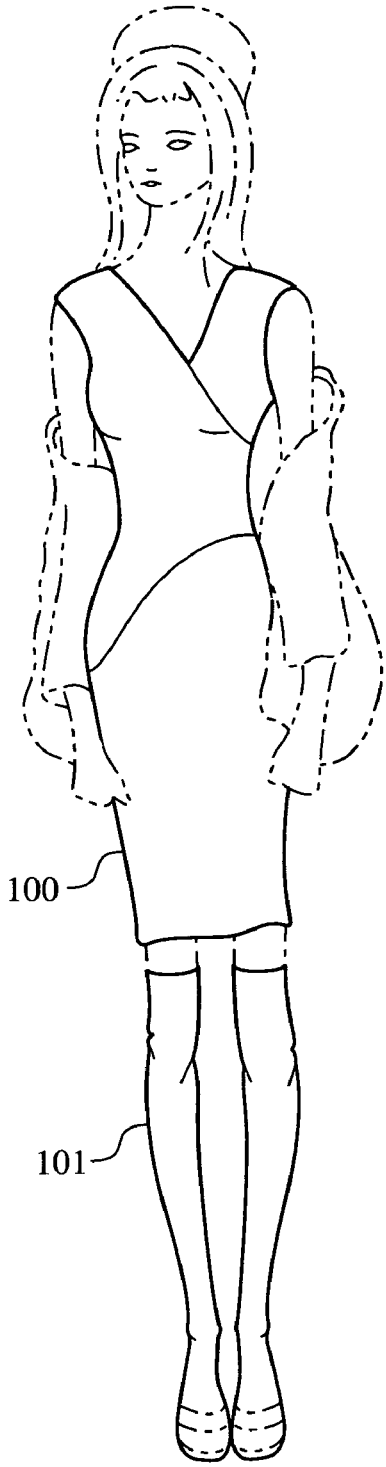
FIG. 10 shows massaging garments comprising a skirt and leggings according to an embodiment of the invention.

Preferably, a massaging garment according to an embodiment of the invention comprises a form fitting garment worn in close proximity to a wearer's skin. For example the massaging garment may be in the form of a body suit 70 as shown in FIG. 7, a skirt 80 or dress as shown in FIG. 8, a jump suit 90 or belt 91 as shown in FIG. 9 or a skirt 100 or leggings 101 as shown in FIG. 10.

The form of the massaging garment may be adapted to the particular treatment desired. For example, a body suit massaging garment may be used for a whole body massaging treatment and leggings or the like may be used for special thigh, buttocks or abdominal treatments. The massaging garment according to various embodiments of the invention may comprise a garment designed to be worn around the home and/or while engaging in physical activity. Additionally, a massaging garment according to various embodiments of the invention may comprise a variety of stylish, fashionable designs as exemplified in FIGS. 7-10. Such designs may be suitable for a variety of occasions. In this way, the opportunities for use of the massaging garment are greatly enhanced.

Accordingly, while a number of embodiments of the present invention have been shown and described, it is obvious that many changes and modifications may be made thereunto without departing from the spirit and scope of the invention.

What is claimed is:

1. A massaging garment configured to be placed in close proximity to a person's skin, the massaging garment comprising:

a fabric;

a pushing element secured to said fabric and configured to push the person's skin away from said fabric, said pushing element comprising a raised carrier having a rounded tip; and a pulling element secured to said fabric and configured to stick to the person's skin and pull the person's skin toward said fabric, said pulling element comprising a plurality of hair-like projections mounted to a flexible base;

wherein the fabric has a continuous arrangement of a plurality of said pushing elements and a plurality of said pulling elements extending along an entire inner surface of the massaging garment;

wherein said plurality of pushing elements and said plurality of pulling elements produce a massaging effect on the person's skin; and wherein the massaging garment is wearable on the person.

2. The massaging garment according to claim 1, wherein said fabric further comprises a woven fabric comprising a plurality of fibers arranged to form a plurality of spaces between adjacent fibers and a plurality of intersections where fibers cross.

3. The massaging garment according to claim 2, wherein at least one of said plurality of pushing elements is disposed at least one of said plurality of spaces.

4. The massaging garment according to claim 2, wherein at least one of said plurality of pushing elements is disposed at least one of said plurality of intersections.

5. The massaging garment according to claim 2, wherein at least one of said plurality of pulling elements is disposed at least one of said plurality of spaces.

6. The massaging garment according to claim 2, wherein at least one of said plurality of pulling elements is disposed at least one of said plurality of intersections.

7. The massaging garment according to claim 1, further comprising an antibacterial additive.

8. The massaging garment according to claim 1, wherein the plurality of pulling elements comprises a plurality of hair-like projections mounted to a flexible base.

9. The massaging garment according to claim 8, wherein the plurality of hair-like projections are adapted to create a capillary action.

10. The massaging garment according to claim 8, wherein the plurality of hair-like projections comprise hydrophobic or hydrophilic materials.

11. The massaging garment of claim 1, wherein the fabric comprises a stretchable fabric.

12. The massaging garment of claim 11, wherein the stretchable fabric comprises a double stretch fabric.

13. The massaging garment of claim 11, wherein the fabric is configured as a form fitting garment worm in close proximity to the person's skin.

14. The massaging garment of claim 13 wherein the form fitting garment is selected from the group consisting of a body suit, a short, a dress, a jumpsuit, a belt, a legging, and combinations thereof.

15. The massaging garment of claim 1, wherein fabric promotes absorption of a topically applied moisturizer or medicine on the person's skin.

16. The massaging garment of claim 1, wherein the raised pushing elements comprise a raised carrier with a rounded top.

* * * * *